US006056208A

United States Patent [19]

Pirker et al.

[11] Patent Number: 6,056,208

[45] Date of Patent: May 2, 2000

[54] APPARATUS FOR PREVENTING DRIPPING FROM CONDUIT OPENINGS

[75] Inventors: Willibald Pirker, Bad Bleiberg; Franz Sumnitsch, Klagenfurt, both of Austria

[73] Assignee: SEZ Semiconductor-Equipment Zubehor fur die Halbleiterfertigung AG, Villach, Austria

[21] Appl. No.: 09/156,598

[22] Filed: Sep. 18, 1998

[30] Foreign Application Priority Data

Sep. 18, 1997 [AT] Austria ..... 1578/97

[51] Int. Cl.[7] ..... B05B 15/02

[52] U.S. Cl. ..... 239/119; 239/120

[58] Field of Search ..... 239/103, 104, 239/105, 106, 119, 112, 120, 290; 222/571

[56] References Cited

U.S. PATENT DOCUMENTS

| | | | |
|---|---|---|---|
| 3,583,634 | 6/1971 | Sheetz | 239/103 |
| 3,792,724 | 2/1974 | Hunter | 141/115 |
| 4,362,572 | 12/1982 | Wallace | 239/106 |
| 4,911,267 | 3/1990 | Matsuda et al. | 184/6 |
| 5,536,313 | 7/1996 | Watanabe et al. | 239/119 |
| 5,720,433 | 2/1998 | Forker | 239/119 |
| 5,756,155 | 5/1998 | Tzeng et al. | 239/120 |
| 5,830,334 | 11/1998 | Kobayashi | 239/104 |
| 5,918,810 | 7/1999 | Fukano et al. | 239/119 |
| 5,927,605 | 7/1999 | Odajima et al. | 239/119 |

FOREIGN PATENT DOCUMENTS

| | | |
|---|---|---|
| 0 103 484 | 3/1984 | European Pat. Off. . |
| 0 402 535 | 12/1990 | European Pat. Off. . |
| 0 444 714 | 5/1994 | European Pat. Off. . |
| 2 665 682 | 2/1992 | France . |
| 250 846 | 10/1987 | Germany . |
| 2 002 331 | 2/1979 | United Kingdom . |
| WO 86/04047 | 7/1986 | WIPO . |

*Primary Examiner*—Andres Kashnikow
*Assistant Examiner*—Jorge Bocanegra
*Attorney, Agent, or Firm*—Young & Thompson

[57] ABSTRACT

To prevent dripping of liquid from an outlet opening of a line, a drip suction device is assigned to the end of the line; the drip suction device has a housing which surrounds the end of the line with the formation of a chamber connected to the interior of the line via through openings and negative pressure can be applied to it via another line to suck up liquid residues which remain in the area of outlet opening after the liquid flow through the line is shut off, and a circuit to activate the drip suction device to apply negative pressure to the chamber when the liquid flow through the line is interrupted by a shutoff element assigned to the line.

15 Claims, 2 Drawing Sheets

APPARATUS FOR PREVENTING DRIPPING FROM CONDUIT OPENINGS

BACKGROUND OF THE INVENTION

The invention relates to an arrangement for preventing dripping of liquids from line openings.

DESCRIPTION OF THE RELATED ART

The area of application of the invention is for example lines in elution units with which in the production of semiconductor wafers treatment liquids are applied to these wafers. These elution units are used for example in etching devices, as is described in EP 444 714 B.

Lines in which dripping is to be prevented are for example also lines in filling systems in the beverage industry.

In the proposals for solving the problem of dripping, it should be considered that measures should not adversely affect the constant volume flow and the constant flow speed of the liquid from the line and that the liquid flow must be turned both on and off without (significant) time delay. The goal is for the liquid column emerging from the line to separate without dripping, when for example a cutoff element is closed. Dripping is undesirable since in the area of semiconductor engineering individual droplets on the surface of the semiconductor wafer (silicon wafer) would lead to an irregular process result. Thus, for example a drop of etching acid can lead to an unwanted etching trace. In the beverage industry dripping is disadvantageous since the drums being filled with the beverage are fouled externally by dripping beverage so that they become unattractive (juices are usually sticky!).

To solve this problem various proposals have been made to date. Often valves are used which upon closing suck back a small amount of liquid. These valves (so-called suck-back valves) suck the liquid column back about 10 cm for a ¼ inch hose (inside diameter roughly 5 mm, cross section roughly 0.2 $mm^2$), i.e. roughly 2 ml of liquid. At a volume flow of 2.5 l/min for a ¼ inch hose the flow speed is roughly 2 m/sec. Since silicon wafers are becoming larger and larger (currently diameter up to 300 mm) a larger and larger volume flow is necessary for treatment. At present volume flows up to 6 l/min are required. For a ¼ inch hose this requires a flow speed of roughly 5 m/sec; this entails additional problems (high pressure loss in the line, major delays in the flow of the liquid column during shutoff). To prevent this, larger hose diameters (⅜ inch hose) are used. The greater hose diameter reduces the flow speed again to the original 2 m/sec. For ⅜ inch hose (inside diameter roughly 8 mm, cross section roughly 0.5 $cm^2$) the sucked back volume of the suck-back valve only corresponds more to a suck-back height of 4 cm. This results in unwanted dripping occurring repeatedly for larger line cross sections together with the small suck-back height, regardless of using suck-back valves. This especially when due to surface tension the meniscus forming on the bottom end of the liquid column tilts, an air bubble migrates to the top and the liquid drips from the end of the line.

Another problem arises in the delivery of gas-containing liquids in which at a low volume flow in spite of using suck back valves dripping occurs as a result of bubble formation in the line.

EP 402 535 B1 discloses a metering device which has a valve, an adjustable piston and a porous insert on the outlet opening.

In the known device the piston moves away from the outlet opening after the valve closes, so that in the area of the outlet opening negative pressure forms which is intended to prevent liquid from dripping out of the outlet opening.

DD 250 846 A3 describes a chamber valve for drip-free closing of liquid containers; a collar forms its chamber through which the liquid to be metered flows. When the valve is open the collar is compressed (small inside space of the chamber) and when the valve is closed it is stretched (larger inside space of the chamber). In the chamber, by increasing its volume when the valve closes (stretching of the collar) a negative pressure forms which sucks back the liquid from the outlet opening.

In the valve as claimed in DD 250 846 A3 the liquid remains in the valve chamber and/or in the area between the outlet opening and the valve. Gassy liquids would nevertheless drip in this device.

SUMMARY OF THE INVENTION

The object of the invention is to make available an arrangement with which dripping, even with a high volume flow and/or when delivering gas-containing liquids, is reliably prevented.

The invention reliably achieves the aforementioned object and reliably prevents dripping of liquid from lines, especially also at a high volume flow and in the case of gas-containing liquids. Since liquid is sucked away directly in front of the outlet opening of the line, liquid can no longer emerge from the opening of the line (drip).

In one simple embodiment around the outlet opening there is a chamber to which a negative pressure is applied at a given time.

It is advantageous if in the area of the outlet opening in the wall of the line there are holes through which liquid is sucked under the action of the negative pressure prevailing in the chamber provided around the outlet opening.

To prevent unwanted withdrawal of liquid in the area of the end of the line by the chamber under negative pressure, in the chamber at the end of the line negative pressure is produced only when delivery of liquid through the line has been stopped (or shortly before), for example, by applying negative pressure to the chamber only when the cutoff device which interrupts the liquid flow through the line closes in the line.

Liquid sucked via the negatively pressurized chamber can be disposed of or returned to the liquid cycle.

Other details, features and advantages of the invention derive from the following description of the embodiments of the invention shown in the drawings.

DESCRIPTION OF THE PREFERRED EMBODIMENTS

Figure 1:
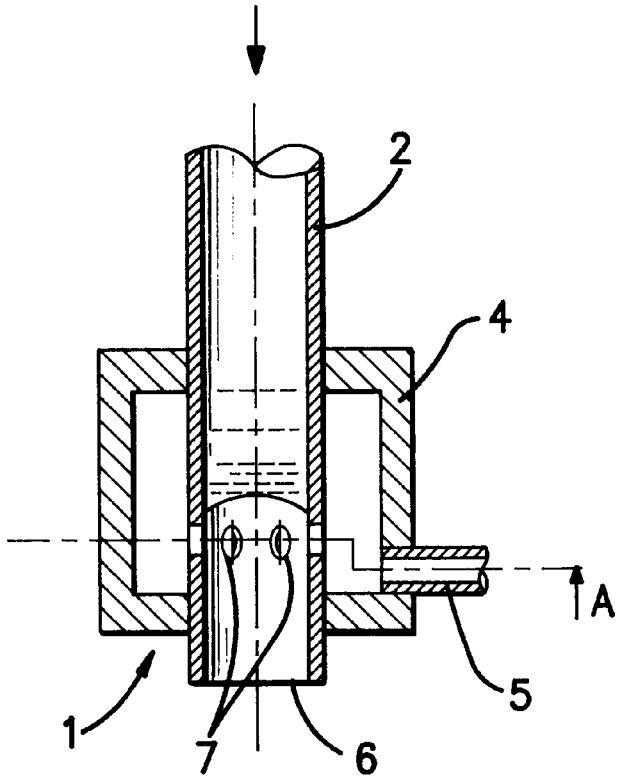
FIG. 1 shows a section of an arrangement as claimed in the invention, along line B—B in FIG. 2.
Figure 2:
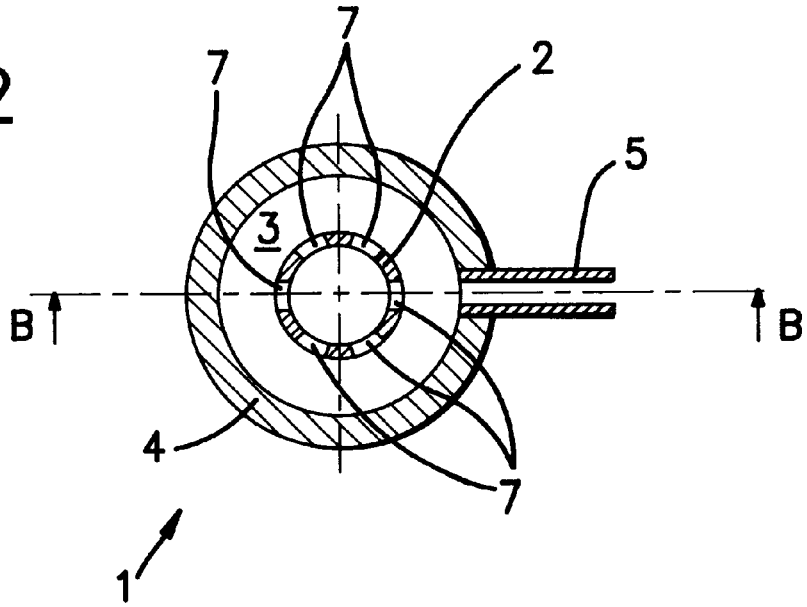
FIG. 2 shows a section along line A—A in FIG. 1.

FIGS. 1 and 2 shows the outlet end of (pipe)line 2. Liquid emerges from line 2 via opening 6 on its end. To control liquid flow through line 2, there is at least one shutoff device (compare FIG. 3) which is made for example as a suck-back valve. At a (short) distance from its end 6, means 1 is assigned to line 2 and is used to prevent dripping of liquid from outlet opening 6 of line 2.

In this embodiment means 1 for sucking liquid consists of housing 4 which is for example cylindrical, which is located around line 2, and which borders chamber 3 which extends around line 2 to the outside. To housing 4 line 5 is connected via which negative pressure can be produced in chamber 3. For this reason line 5 is connected to a negative pressure source (compare FIG. 3), and there can be shutoff elements in line 5 which leads to the negative pressure source.

In the wall of line 2 in the area of chamber 3 there are several through openings 7 (in principle a single through opening 7 is enough). Through openings 7 can be made as perforations, therefore can have a very small diameter. The distance of the area in which there are through openings 7 in pipeline 2 from outlet opening 6 of line 2 can be made as short as desired.

When negative pressure is applied to chamber 3 in housing 4, liquid residues which remain after the liquid flow is stopped in line 2 in the area of through openings 7 are sucked through through openings 7 into chamber 3 and further through line 5. This prevents dripping of liquid from outlet opening 6 of line 2.

To prevent liquid which is to emerge from outlet opening 6 on the end of line 2, if for example an etching liquid is applied to a semiconductor wafer, from being sucked into line 5 through through openings 7 and chamber 3, negative pressure is applied to line 5 and thus chamber 3 only if necessary, therefore only when the flow of liquid through line 2 is interrupted.

Alternatively there can be measures with which through openings 7 in the wall of line 2 are closed when liquid is flowing through line 2. These measures can be shutoff means, for example in the form of a sleeve in which there are holes and which can twist relative to the end of line 2. If the sleeve is twisted such that the holes in it line up with through opening 7, the negative pressure in chamber 3 acts to suck up the liquid residues.

Figure 3:
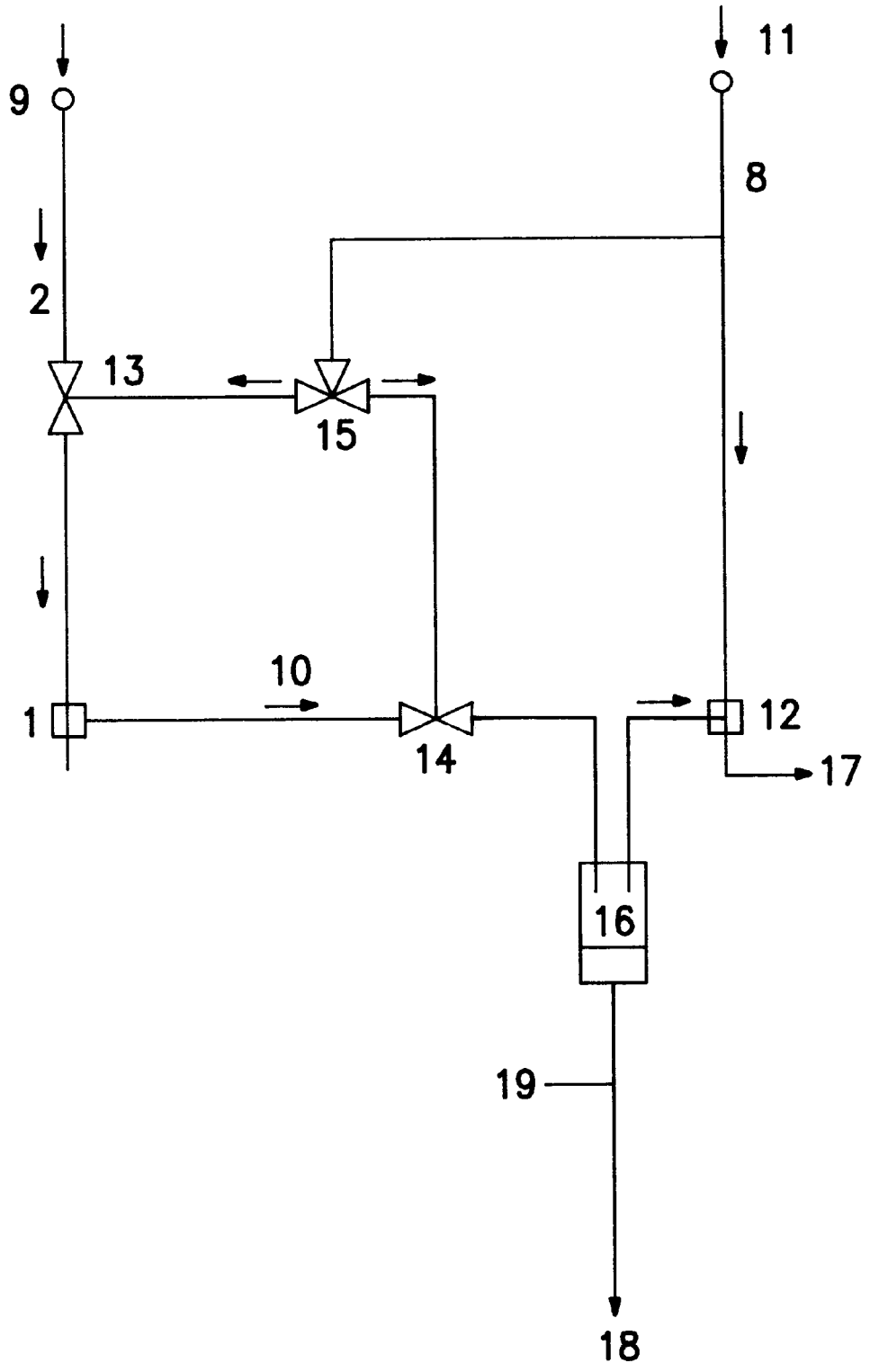
FIG. 3 shows a sample embodiment of the circuit of the arrangement as claimed in the invention.

FIG. 3 shows one possible circuit for how means 1 is activated only if necessary and therefore negative pressure can be applied to chamber 3.

The liquid flows through line 2. Line 8 is a compressed air line which is divided into two branches. Simultaneous shutoff of liquid flow 9 in line 2 and application of negative pressure in chamber 3 can be ensured as follows. Via Venturi nozzle 12, with compressed air flow 11 in one branch of compressed air line 8 suction flow 10 is produced which applies negative pressure to chamber 3. At the instant at which valve 13 in line 2 turns off for the liquid flow, valve 14 opens for suction flow 10. This is done in compressed air-controlled valves by switching the control air from one valve to another with three-way valve 15. Valve 13 for the liquid flow can be made as a suck-back valve, but not necessarily so. Separation of the gas and liquid in the flow of medium which comes from means 1 with chamber 3 takes place in the conventional manner, for example by mist collector 16. Exhaust air is routed into discharge 17. Liquid is disposed of either via line 18 or is supplied again to the liquid cycle via line 19.

In another embodiment of the invention (not shown) the negative pressure can be produced by a vacuum pump. In this case the suction flow is switched via its own valve. Simultaneous cutoff of the liquid flow and starting of the suction flow take place for example electrically in this case.

It applies to both embodiments that switching of the liquid flow and suction flow can take place not only at the same time, but also at a time interval, for example, a few seconds, offset in time. It is preferred that suction of the liquid via chamber 3 is activated shortly before the liquid flow through line 2 is shut off.

In the invention, by lateral suction the downward pointing meniscus of the liquid column is re-formed again and again, even if the meniscus "tilts", so that an air bubble cannot form which migrates upward and liquid cannot drip.

In summary, one embodiment of the invention can be described as follows.

To prevent dripping of liquid from outlet opening 6 of line 2, drip suction means 1 is assigned to the end of line 2. Drip suction means 1 has housing 4 which surrounds the end of line 2 with the formation of chamber 3. Chamber 3 is connected to the interior of line 2 via through openings 7 and negative pressure can be applied to it via line 5 to suck up liquid residues which remain in the area of outlet opening 6 after the liquid flow through line 2 is shut off. A circuit is proposed which only activates drip suction means 1, for example applies negative pressure to chamber 3, when the liquid flow through line 2 is interrupted by a shutoff element assigned to line 2.

What is claimed is:

1. An arrangement for preventing the dripping of residue liquids from an outlet opening of a line after the normal flow of liquids has been terminated, the arrangement comprising:

a line with an outlet opening; and a drip suction device, the line adapted for providing a flow path for liquids and the outlet opening adapted for providing a liquids flow path outlet, said line and said outlet opening configured such that residue liquids present in said line near said outlet opening would drip from said outlet opening absent action of said drip suction device, said drip suction device comprising a chamber operatively connected to a negative pressure source and dynamically connected to said line adjacent to said outlet opening for removing residue fluids from an interior of said line and into said chamber, said line further comprising at least one through opening for communicating a negative pressure from the negative pressure source, via said chamber, to an interior region of said line.

2. The arrangement of claim 1, wherein said chamber is set a distance apart from said outlet opening.

3. The arrangement of claim 1, wherein said chamber comprising a housing defining a volume of said chamber.

4. The arrangement of claim 3, wherein said drip suction device further comprises a negative pressure line connected to said housing and to said negative pressure source.

5. The arrangement of claim 1, wherein said housing surrounds an entire circumference of said line.

6. The arrangement of claim 1, wherein said at least one through opening is located apart from said outlet opening.

7. The arrangement of claim 1, further comprising a plurality of said at least one through opening, said plural through openings being distributed along a circumference of said line and apart from said outlet opening.

8. The arrangement of claim 4, further comprising:

a shutoff element attached to said line;

a negative pressure control valve in said negative pressure line for controlling an application of negative pressure from the negative pressure source; and a controller for opening said negative pressure control valve upon the closure of said shutoff element.

9. The arrangement of claim 4, wherein said negative pressure line is operatively connected to a venturi nozzle of the negative pressure source, wherein said venturi nozzle creates the negative pressure.

10. The arrangement of claim 4, wherein said negative pressure line is operatively connected to a mist collector.

11. The arrangement of claim 10, wherein said mist collector is connected to a disposal line.

12. The arrangement of claim 10, wherein said mist collector is connected to a liquid recycle line.

13. The arrangement of claim 8, wherein said controller comprising a delay for opening said negative pressure control valve, after a time delay, upon the closure of said shutoff element.

14. An arrangement for preventing the dripping of un-pressurized residue liquids from an outlet opening of a line, the arrangement comprising:

a line with an outlet opening and plural through holes located apart from said outlet opening and around a circumference of said line; and a drip suction device surrounding an exterior of said line and comprising a chamber in vacuum communication with said plural through holes and operatively connected to a negative pressure source for removing residue liquids from an interior of said line through said plural through holes.

15. A drip suction device for removing residue liquids from an outlet region of a line having a plurality of through holes located apart from the outlet region, the drip suction device comprising:

a housing completely surrounding a circumference of the line and the plurality of through holes;

a connection port penetrating said housing, said connection port for connection to a negative pressure line, said connection port in communication with the plurality of through holes for removing residue liquids from an interior of the line through the plurality of through holes and through the connection port.

* * * * *